US005857763A

United States Patent [19]

Chen

[11] Patent Number: 5,857,763

[45] Date of Patent: Jan. 12, 1999

[54] LIGHTING MIRROR FIXTURE

[75] Inventor: Wilton C.T. Chen, Taipei, Taiwan

[73] Assignee: Vaxcel International Trading Company, Ltd., Taipei, Taiwan

[21] Appl. No.: 884,530

[22] Filed: Jun. 27, 1997

Related U.S. Application Data

[60] Provisional application No. 60/020,881 Jun. 28, 1996.

[51] Int. Cl.[6] ..... F21V 21/00

[52] U.S. Cl. ..... 362/140; 362/247; 362/249; 362/437

[58] Field of Search ..... 362/140, 235, 362/236, 241, 247, 249, 377, 378, 369, 390, 437, 443; 439/350

[56] References Cited

U.S. PATENT DOCUMENTS

| | | | |
|---|---|---|---|
| 1,663,655 | 3/1928 | Guth | 362/311 |
| 1,714,518 | 5/1929 | Owen | 362/361 |
| 1,727,149 | 9/1929 | White | 362/439 |
| 1,975,814 | 10/1934 | Weldon | 362/306 |
| 2,014,690 | 9/1935 | Minton | 362/135 |
| 2,565,575 | 8/1951 | Rosenthal | 362/140 |
| 3,126,160 | 3/1964 | Berger | 439/894 |
| 3,737,646 | 6/1973 | Burrows | 362/140 |
| 4,599,682 | 7/1986 | Stephens | 362/103 |
| 4,695,929 | 9/1987 | Smith | 362/140 |
| 5,140,506 | 8/1992 | Katz | 362/135 |
| 5,469,344 | 11/1995 | Kotsakis | 362/249 |
| 5,491,619 | 2/1996 | Gill | 362/390 |

*Primary Examiner*—Alan Cariaso
*Attorney, Agent, or Firm*—Paul Adams; Deborah A. Peacock

[57] ABSTRACT

This invention relates to a lighting fixture which comprises a frame holding a light bulb socket covered by a mirror such as may be used in a bathroom or other commercial or residential room.

5 Claims, 2 Drawing Sheets

LIGHTING MIRROR FIXTURE

This application claims the benefit of the filing of Provisional Application Ser. No. 60/020,881, entitled Friction-Fit Cup Fastening Device filed on Jun. 28, 1996, and the specification thereof is incorporated herein by reference.

BACKGROUND OF THE INVENTION

1. Field of the Invention (Technical Field)

This invention relates to a lighting fixture which comprises a frame holding a light bulb socket covered by a mirror such as may be used in a bathroom or other commercial or residential room.

2. Background of the Invention

It is well known to make a lighting fixture which has a housing and as its front decorative surface, a mirror. Such housing may be mounted to a wall surface, or recessed in a suitable opening in the wall. Typically, this type of fixture has a plurality of electric light bulbs that are spaced a relatively close distance. The glass mirror has a number of holes. Sockets are attached to a front housing plate and bulbs in the sockets project through the mirror openings. Electrical wires within the building walls are run through an opening in a rear mounting plate for the housing and then fan out to be attached to each individual socket. To install this type of fixture, the rear mounting plate is secured to the wall with the wires projecting through an opening in the plate a sufficient distance to allow an electrician to attach the wires to individual sockets mounted on the front housing plate. These wires are then coiled or otherwise formed into a service loop, the front and rear housing plates are then mated, and suitable fasteners are used to maintain the front and rear housing plates in mated engagement.

The sole purpose of the front housing plate is to support the light bulb sockets and the mirror. It would be desirable to eliminate the front housing plate since it simply contributes additional cost and weight to the lighting fixture. Furthermore, it requires the installing electrician to make the electrical connections between each of the sockets and the wires on site. It would be more efficient and less expensive to attach the wires to sockets mounted on the rear mounting plate of the housing either at the factory and delivered with wire pig tails or on site but without requiring the electrician to balance or otherwise support the delicate mirror during the wire connection process. Mounting the sockets on the rear mounting plate rather than on a front housing plate would also eliminate the service loop of wires that is currently required.

It is therefore an object of the present invention to eliminate the front housing plate and yet provide a secure method for attaching a mirror to the plate which supports the light bulb sockets.

SUMMARY OF THE INVENTION (DISCLOSURE OF THE INVENTION)

Briefly stated, the present invention comprises a lighting fixture including a mounting bracket or housing, one or more electrical light bulb sockets mounted in the bracket or housing, a mirror having at least one opening in registry with the electrical socket, and a ferrule insertable over the socket and having means within the ferrule to permit the use of a screw to attach the ferrule to the housing, the diameter of the ferrule being slightly larger than the opening in the mirror so as to hold the mirror securely to the housing.

Other novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The foregoing summary, as well as the following detailed description of a preferred embodiment, is better understood and read in conjunction with the appended drawings. For the purpose of illustrating the invention, there is shown in the drawings at least one embodiment which is the presently preferred embodiment, it being understood, however, that the invention is not limited to the specific method or apparatus disclosed. In the drawings.

DESCRIPTION OF THE PREFERRED EMBODIMENTS

(BEST MODES FOR CARRYING OUT THE INVENTION)

In current lighting fixtures of the general type here disclosed, the housing in which the electric light sockets are enclosed and covered by an aesthetically desirable mirror comprises a front housing plate, a rear mounting plate for the housing, and an opening in the rear plate through which a plurality of wires pass from inside the wall of a building to form a service loop. The front plate carries a plurality of electric light bulb sockets, each of which may receive a light bulb. A glass mirror is fixedly mounted to the front surface of the front plate. When installed, the wires are pulled through the building wall, inserted through opening in the rear mounting plate which is then secured to the wall with standard fasteners. When it is desired to add the lighting fixture housing to the rear mounting plate, such as when the building is nearly completed and ready for occupancy, the wires may be attached to the individual sockets so as to effect the electrical connection. To do so, the electrician must position the mirror and front housing plate sufficiently close to the wall and rear mounting plate so that the service loop of the wires is not so long as to prevent enclosure within the housing. Since the mirror is obviously delicate, supporting the mirror and front housing plate at an elevated location, where the lighting fixture is normally mounted, becomes a difficult balancing act for one electrician and oftentimes a helper may be required to properly assemble the parts.

Figure 1:
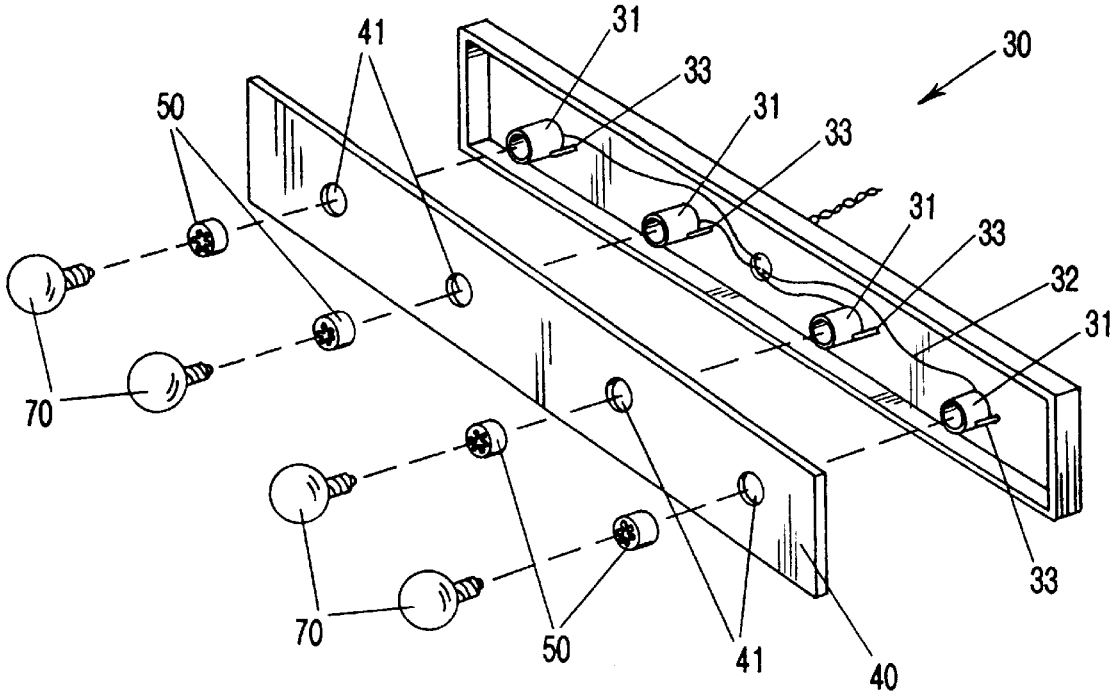
FIG. 1 is an exploded view of the lighting fixture of the present invention.

Directing attention to FIG. 1, there is shown an exploded view of the lighting fixture of the present invention which includes a rearmounting plate for housing 30 which is adapted to be secured to a building wall by fasteners (not shown). Unlike the prior art fixture, the light bulb sockets, four of which are shown at 31, are fixedly mounted on the rear mounting plate 30 and are individually electrically connected to the building wiring system at the time the mounting plate is installed, through the pigtails 32 that pass through an opening in mounting plate 30. The plate 30 also includes one or more fastening devices 33 for the purpose to be described.

The lighting fixture also comprises a mirror glass 40, but unlike the prior art device, the mirror does not include any front housing plate. Instead, the openings 41 in the mirror 40 are larger in diameter than the diameter of the light bulb sockets 31. The mirror is attached to the mounting plate 30 with a plurality of ferrules 50, one for each light bulb socket 31.

Figure 2:
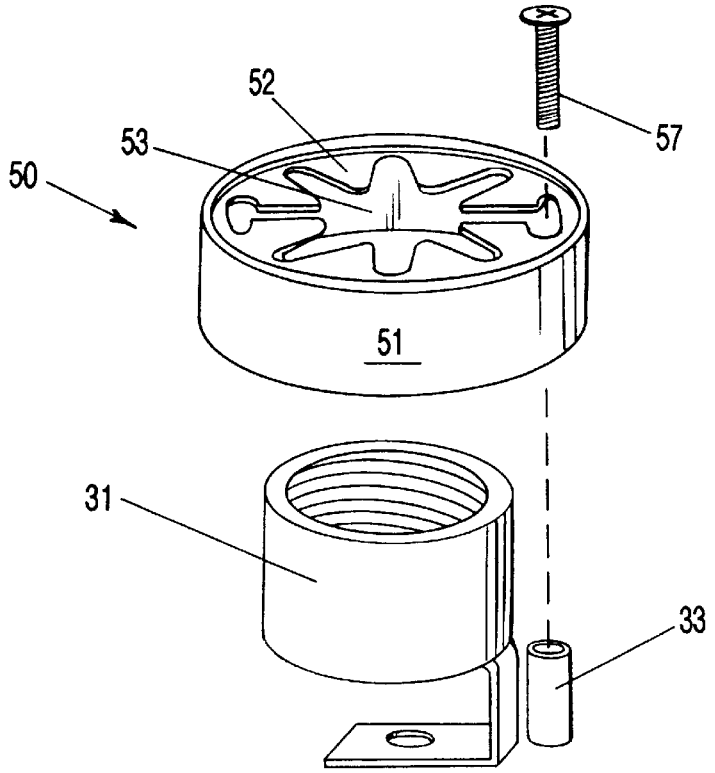
FIG. 2 is an enlarged, detailed exploded view of the ferrule and accompanying components of the present invention.
Figure 3:
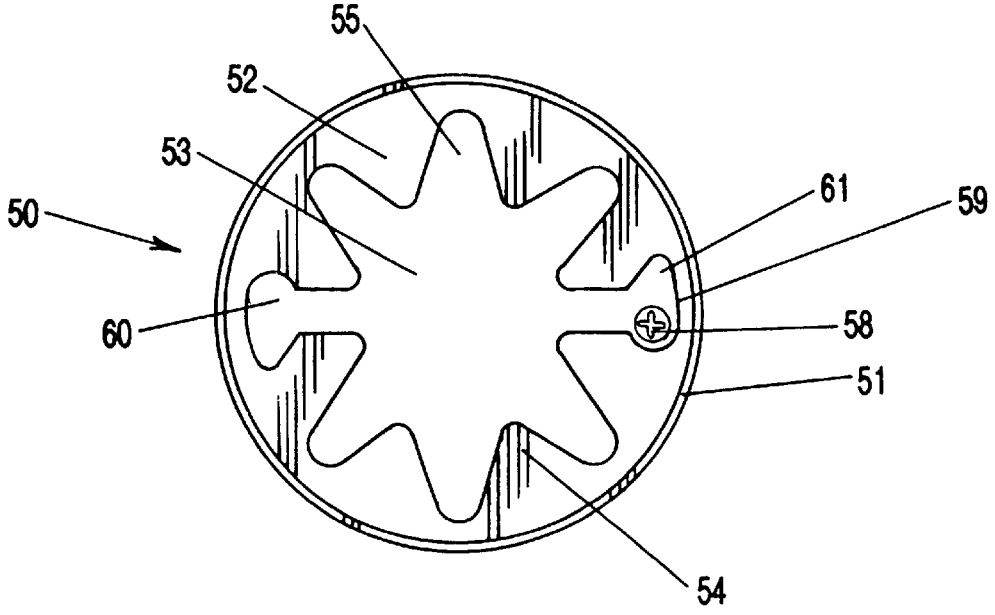
FIG. 3 is a plan view of the ferrule.
Figure 4:
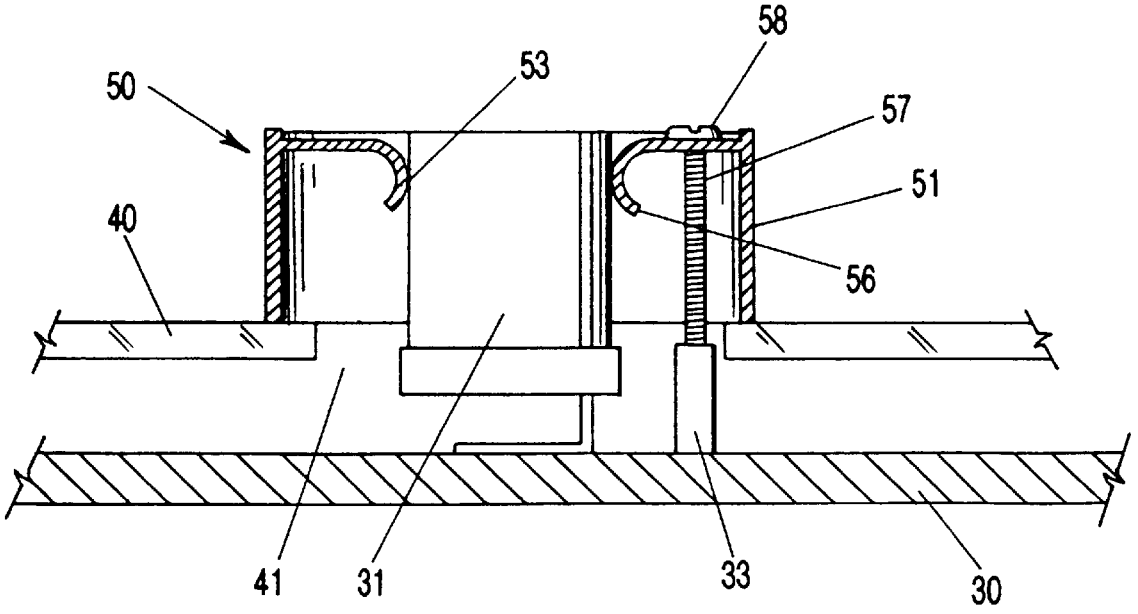
FIG. 4 is a side elevation sectional view of the ferrule and accompanying components of the lighting fixture.

Referring now to FIG. 2, it will be seen that the mounting ferrule 50 comprises a cylindrical metallic body 51 having a diameter slightly larger than the diameter of mirror opening 41 and a circular member 52 axially spaced from each open end of the body 51 and transversely mounted to the ferrule axis and having a central opening 53 for receiving one of the sockets 31 fixedly mounted on mounting plate 30. The member 52 has a plurality of projections 54 (see FIG. 3) that define radially extending tapered openings 55. The material of member 52 is somewhat resilient so that the projections 54 at the inner edge when formed into downward extending curved tabs 56 (see FIG. 4) contact the outer surface of the socket 31 so as to frictionally engage the socket, centering the ferrule 50 in axial alignment or registry with the socket 31. Two of the openings 55 are designed for cooperating with a fastening means comprising the device 33 (in the embodiment shown, a female screw member) and a screw 57 having a head 58 to secure the ferrule 50 to the mounting plate 30 thereby also securing mirror 40 to plate 30. The two radial openings, one of which at 59 will be described, for cooperating with the fastening means has two arcuate openings 60 and 61 at the radially outermost end. The opening 60 has a width greater than the diameter of head 58 of screw 57. The opening 61 has a width less than the diameter of head 58 but slightly larger than the diameter of the screw 57 body or threaded shaft.

In order to secure the mirror 40 onto the mounting plate 30, the opening 41 in the mirror is placed in approximate registry with the socket 31 that is carried by the mounting plate 30. Then, the worker may take a friction fit ferrule 50 and insert it over the socket 31 where the tabs 56 hold it in place. In the common fixture where there are multiple light bulbs, each of the friction fit ferrules 50 would be positioned over one of the sockets 31 so that each ferrule 50 and corresponding socket 31 are axially aligned or in registry. The ferrule is positioned after the screw 57 is partially engaged in the female portion 33 of the fastening means by aligning the opening 60 in the ferrule with the screw head 58 and axially moving the ferrule toward the socket until the inner edge of the ferrule abuts the mirror. The ferrule may then be rotated so that the screw body enters the other narrower arcuate opening 61. The screw is then tightened to force the ferrule inner edge firmly against the mirror. The mirror is thus secured to the mounting plate. When three or four of such ferrules are positioned and tightened, the multiple points of securement assure a semi-permanent mounting of the mirror to the mounting plate. Light bulbs 70 may then be screwed into sockets 31 in conventional manner.

It will be appreciated that because the light bulb sockets 31 are permanently attached to the mounting plate 30, the plate may come from the factory with each socket connected to electrical wires which form pig tails that may then be spliced to the wire that is pulled in to the building during construction. Alternatively, if the wires are connected to the mounting plate at the construction site, the workman need merely support the mounting plate 30, which is more rugged and durable in construction compared to the mirror, and it is easier and safer to effect the electrical connection between the building wires and the light bulb sockets. Furthermore, once the mounting plate has been attached to the wall, it will be readily seen that mounting the mirror is extremely simplified and yet it is held firmly in position through the provision of the force exerted by each of the ferrules 50 on the mirror. Moreover, the frictional fit of the ferrule eases installation since each of the ferrules are loosely or temporarily supported by the sockets until each is individually tightened. By first inserting the ferrules on the sockets and then adjusting the position of the mirror relative to the sockets and mounting plate 30, before tightening screws 57, assembly will be rapid, efficient, and low cost.

Although the invention has been described in detail with particular reference to a single embodiment, other embodiments can achieve the same results. Variations and modifications of the present invention will be obvious to those skilled in the art and it is intended to cover in the appended claims all such modifications and equivalents. The entire disclosures of all references, applications, patents, and publications cited above and the corresponding application(s), are hereby incorporated by reference.

What is claimed is:

1. A combined lighting and mirror fixture comprising:

a housing including a mounting plate, at least one electrical light bulb socket mounted on an mounting plate;

a mirror having at least one opening with a diameter larger than an external diameter of the bulb socket, said mirror positioned relative to said housing so that said opening is in registry with said socket;

a mounting ferrule having a diameter larger than the diameter of the mirror opening, including a member fixedly mounted in the ferrule transverse to the ferrule axis, said member having a central opening larger than the external diameter of the socket and a plurality of radially extending openings, at least one of said radially extending openings having arcuate openings adjacent the radially outermost end, one of said arcuate openings having a width greater than another of said arcuate openings and fastening means including a threaded screw for engagement with said mounting plate, said screw having a head diameter greater than the width of one of said arcuate openings and smaller than the width of the other of said arcuate openings, whereby said ferrule may be positioned over said socket and in frictional engagement therewith, in contact with said mirror surface, with said screw head projecting above said ferrule member through said one larger arcuate opening, and rotated so that the ferrule repositions the screw into the smaller arcuate opening so that tightening the screw secures the mirror to the housing.

2. The fixture of claim 1 wherein each pair of adjacent radially extending openings define a projection, the inner edges of all said projections defining a circle with a diameter slightly less than the outer diameter of the bulb socket.

3. The fixture of claim 2 wherein said ferrule member is formed of resilient material.

4. The fixture of claim 3 wherein the inner edge of each projection of said ferrule member forms a resilient tab which bears against the outer surface of the socket.

5. The fixture of claim 1 wherein at least two of the radially extending openings have arcuate openings.

* * * * *